US010673140B2

(12) United States Patent
Boutayeb et al.

(10) Patent No.: US 10,673,140 B2
(45) Date of Patent: Jun. 2, 2020

(54) DUAL POLARIZED ELECTRONICALLY STEERABLE PARASITIC ANTENNA RADIATOR (ESPAR)

(71) Applicant: Huawei Technologies Co., Ltd., Shenzhen (CN)

(72) Inventors: Halim Boutayeb, Kanata (CA); Paul Robert Watson, Kanata (CA); Weishan Lu, Guangdong (CN); Tao Wu, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 234 days.

(21) Appl. No.: 15/726,021

(22) Filed: Oct. 5, 2017

(65) Prior Publication Data

US 2018/0048064 A1 Feb. 15, 2018

Related U.S. Application Data

(60) Division of application No. 14/843,494, filed on Sep. 2, 2015, now Pat. No. 9,793,606, which is a (Continued)

(51) Int. Cl.

| | |
|---|---|
| ***H01Q 19/00*** | (2006.01) |
| ***H01Q 3/44*** | (2006.01) |
| ***H01Q 9/04*** | (2006.01) |
| ***H01Q 21/24*** | (2006.01) |
| ***H01Q 21/29*** | (2006.01) |

(52) U.S. Cl.

CPC ..... *H01Q 3/446* (2013.01); *H01Q 9/045* (2013.01); *H01Q 9/0407* (2013.01); (Continued)

(58) Field of Classification Search

CPC ..... H01Q 3/34; H01Q 3/446; H01Q 9/0407; H01Q 9/0435; H01Q 9/045; H01Q 19/005; H01Q 21/29; H01Q 21/24

See application file for complete search history.

(56) References Cited

U.S. PATENT DOCUMENTS

2003/0214437 A1 11/2003 Rawnick et al.
2005/0179605 A1* 8/2005 Iigusa ..... H01Q 9/20 343/745

(Continued)

OTHER PUBLICATIONS

Kawakami, et al., "Electrically Steerable Passive Array Radiator (ESPAR) Antennas," IEEE Antennas and Propagation Magazine, vol. 47, No. 2, Apr. 2005, 7 pages.

(Continued)

*Primary Examiner* — Dieu Hien T Duong

(74) *Attorney, Agent, or Firm* — Slater Matsil, LLP

(57) ABSTRACT

An electronically steerable antenna with dual polarization is provided, as well as a method for steering such an antenna. An example antenna may include a driven patch element having dual polarity for radiating or receiving a first beam with a first polarization and radiating or receiving a second beam with a second polarization. The antenna includes a parasitic patch element separated from the driven patch element and in a parasitic coupling arrangement to the driven patch element, as well as first and second tuning elements linked to the parasitic patch element to control first and second terminating impedances of the parasitic patch element, respectively. The first terminating impedance at least partly determines a direction of the first beam, and the second terminating impedance at least partly determines a direction of the second beam.

22 Claims, 8 Drawing Sheets

Related U.S. Application Data continuation of application No. PCT/CN2015/084092, filed on Jul. 15, 2015.

(52) U.S. Cl.
CPC ..... *H01Q 9/0435* (2013.01); *H01Q 19/005* (2013.01); *H01Q 21/24* (2013.01); *H01Q 21/29* (2013.01)

(56) References Cited

U.S. PATENT DOCUMENTS

2007/0229357 A1 10/2007 Zhang et al.
2007/0279286 A1 12/2007 Coutts et al.
2009/0256773 A1 10/2009 Lindmark
2009/0309799 A1 12/2009 Hossain
2011/0309980 A1* 12/2011 Ali ..... H01Q 1/1257 342/368
2013/0072136 A1 3/2013 Besoli et al.
2015/0194730 A1 7/2015 Sudo et al.

OTHER PUBLICATIONS

Luther, et al., "A Microstrip Patch Electronically Steerable Parasitic Array Radiator (ESPAR) Antenna With Reactance-Tuned Coupling and Maintained Resonance," IEEE Transactions on Antennas and Propagation, vol. 60, No. 4, Apr. 2012, 11 pages.

* cited by examiner

DUAL POLARIZED ELECTRONICALLY STEERABLE PARASITIC ANTENNA RADIATOR (ESPAR)

CROSS-REFERENCE TO RELATED APPLICATIONS

This application is a divisional of U.S. patent application Ser. No. 14/843,494, filed Sep. 2, 2015, which is a continuation of PCT Patent Application No. PCT/CN2015/084092, filed Jul. 15, 2015, which applications are hereby incorporated herein by reference.

TECHNICAL FIELD

The present disclosure relates generally to antennas, and in some aspects, to electronically steerable antennas with dual polarization.

BACKGROUND

Antennas capable of beam steering, or pattern agility, have a variety of applications. For example, in high-speed wireless communication networks, agile antennas may assist with interference mitigation. Agile antennas also may be employed in point-to-point communication systems, weather monitoring, target tracking radar systems, adaptive beam formers, diversity receivers, direction of arrival (DoA) finders, and a variety of other applications.

Some steerable antenna systems, such as some phased array antennas, make use of phase shifters to control beam direction. Phase shifters may contribute significantly to the cost of an antenna system and may restrict performance. Other antenna systems may make use of beam forming networks, but this may also be relatively costly to implement.

One type of antenna system is an electronically steerable parasitic antenna radiator (ESPAR), sometimes also referred to as an electrically steerable passive array radiator. In ESPAR antennas, a driven antenna element (sometimes also referred to as a feed element or active element) interacts using parasitic coupling with nearby passive antenna elements. In such a parasitic coupling arrangement, the nearby passive antenna elements absorb radiated waves from the driven antenna element and re-radiate them with a different phase and amplitude. The waves radiated and re-radiated from the antenna elements interfere, thus strengthening the antenna system's radiation in some directions and weakening or cancelling the antenna system's radiation in other directions.

In ESPAR, the terminating impedance of each passive antenna element may be adjusted to control a beam direction of the antenna system. Depending on the terminating impedance of each passive antenna element, some passive antenna elements may act as reflectors, generally reflecting waves radiated by the driven antenna element, and some passive antenna elements may act as directors, generally strengthening waves radiated by the driven antenna element in a particular direction.

SUMMARY

In one aspect, there is provided an antenna with a driven patch element having dual polarity for radiating or receiving a first beam with a first polarization and radiating or receiving a second beam with a second polarization. The antenna has a first parasitic patch element separated from the driven patch element and in a parasitic coupling arrangement to the driven patch element. The antenna also has a first tuning element linked to the first parasitic patch element to control a first terminating impedance of the first parasitic patch element, and a second tuning element linked to the first parasitic patch element to control a second terminating impedance of the first parasitic patch element. The first terminating impedance at least partly determines a direction of the first beam, and the second terminating impedance at least partly determines a direction of the second beam.

In another aspect, there is provided a device having an antenna as described above and a controller. The first tuning element is electronically adjustable by the controller to adjust the first terminating impedance, and the second tuning element is electronically adjustable by the controller to adjust the second terminating impedance.

Optionally, the direction of the second beam is substantially unaffected by adjustments to the first terminating impedance, and the direction of the first beam is substantially unaffected by adjustments to the second terminating impedance.

Optionally, the first polarization and the second polarization are orthogonal.

Optionally, the first and second tuning elements include varactors, PIN diodes, and/or micro-electro-mechanical systems (MEMS).

Optionally, the driven patch element is differentially coupled to a first port and differentially coupled to a second port. The first port is an input or output for signals radiated or received in the first beam, and the second port is an input or output for signals radiated or received in the second beam.

Optionally, the differential coupling to the first port includes a passive circuit having arms of differing lengths or includes an active electronic circuit generating signals having opposite phases, and the differential coupling to the second port includes a passive circuit having arms of differing lengths or an active electronic circuit generating signals having opposite phases.

Optionally, the differential coupling to the first port includes a first pair of capacitive patches; and the differential coupling to the second port includes a second pair of capacitive patches.

Optionally, the first pair of capacitive patches are located along a diagonal of a square, and the second pair of capacitive patches are located along an opposing diagonal of the square.

Optionally, the differential coupling to the first port includes a first aperture; and the differential coupling to the second port includes a second aperture.

Optionally, the first aperture is located along a diagonal of a square, and the second aperture is located along an opposing diagonal of the square.

Optionally, the first parasitic patch element is differentially linked to the first tuning element using capacitive patches or aperture coupling, and the second parasitic patch element is differentially linked to the second tuning element using capacitive patches or aperture coupling.

Optionally, the antenna also has a second parasitic patch element separated from the driven patch element and in a parasitic coupling arrangement to the driven patch element. The driven patch element is located between the first parasitic patch element and the second parasitic patch element.

Optionally, the antenna also has a third parasitic patch element separated from the driven patch element and in a parasitic coupling arrangement to the driven patch element, as well as a fourth parasitic patch element separated from the driven patch element and in a parasitic coupling arrangement to the driven patch element. The driven patch element is located between the third parasitic patch element and the fourth parasitic patch element.

Optionally, the first and second parasitic patch elements have a shape based on a square. Two corners of a side of each square facing the driven patch element have had a triangular portion cut away.

In another aspect, there is provided an antenna array having a plurality of antennas as described above or below. The plurality of antennas are spaced apart in a row, and the driven patch elements of the plurality of antennas are aligned.

In a further aspect, there is provided a method including transmitting a first beam and a second beam from an antenna, the first beam and the second beam having respective first and second polarizations. The method includes setting a first terminating impedance of a first parasitic patch element of the antenna, the first parasitic patch element separated from a driven patch element of the antenna and parasitically coupled to the driven patch element, to set a direction of the first beam without substantially affecting a direction of the second beam. The method also includes setting a second terminating impedance of the first parasitic patch element to set the direction of the second beam without substantially affecting the direction of the first beam.

Optionally, the method also includes setting a first terminating impedance of a second parasitic patch element of the antenna while setting the first terminating impedance of the first parasitic patch element, the second parasitic patch element separated from the driven patch element and parasitically coupled to the driven patch element, to set the direction of the first beam without substantially affecting the direction of the second beam. The method also includes setting a second terminating impedance of the second parasitic patch element while setting the second terminating impedance of the first parasitic patch element, to set the direction of the second beam without substantially affecting the direction of the first beam.

BRIEF DESCRIPTION OF THE DRAWINGS

Examples of embodiments will be described in greater detail with reference to the accompanying drawings, in which.

DETAILED DESCRIPTION OF ILLUSTRATIVE EMBODIMENTS

Figure 1:
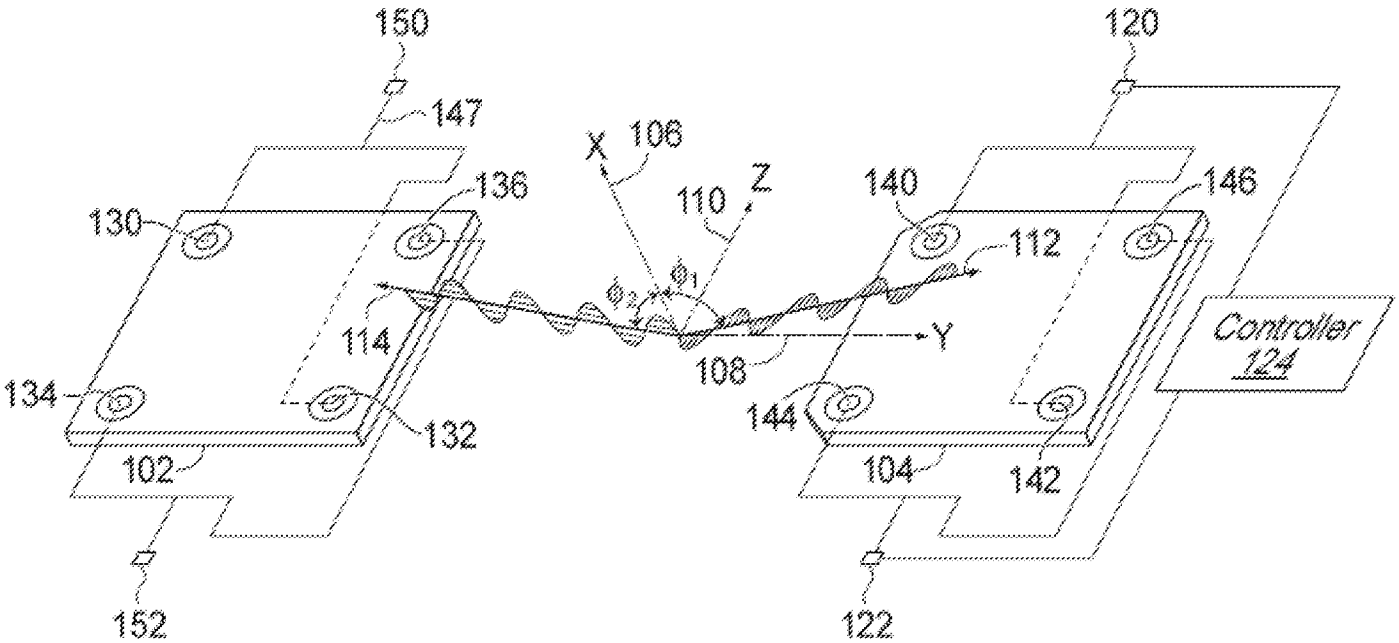
FIG. 1 is a diagrammatic perspective view of a dual polarized ESPAR antenna and controller in accordance with an embodiment of the invention.

FIG. 1 is a diagrammatic perspective view of a dual polarized ESPAR antenna and controller in accordance with an embodiment of the invention. In the example illustrated, driven element 102 is a patch antenna with a square shape. A parasitic element 104 is located in proximity to driven element 102. Parasitic element 104 is a patch antenna with a shape based on a square, wherein two corners of a side of the square facing driven element 102 have had triangular portions cut away. The patch antennas of driven element 102 and parasitic element 104 are made of a conductive material and may be supported by one or more insulating substrates (not shown), for example fiberglass laminate material used for printed circuit boards (PCBs).

Four circular capacitive patches 130, 132, 134, 136 are symmetrically arranged along diagonals of the square shape of driven element 102, each capacitive patch proximal to one of its four corners. Each of the four capacitive patches 130, 132, 134, 136 is made of a conductive material but is electrically insulated from the conductive material of driven element 102. Each of the four capacitive patches 130, 132, 134, 136 may be supported by the same insulating substrate supporting the driven element 102. A first pair 130, 132 of the capacitive patches is differentially coupled to a first terminal 150 serving as a first port. A second pair 134, 136 of the capacitive patches is differentially coupled to a second terminal 152 serving as a second port.

Four circular capacitive patches 140, 142, 144, 146 are symmetrically arranged along diagonals of the square shape on which the shape of parasitic element 104 is based, each capacitive patch being proximal to one of its four corners. Each of the four capacitive patches 140, 142, 144, 146 is made of a conductive material and may be supported by the same insulating substrate supporting the parasitic element 104, but is electrically insulated from the conductive material of parasitic element 104. A first pair 140, 142 of the capacitive patches is differentially coupled to a first tuning element 120 for adjusting a first terminating impedance of parasitic element 104. A second pair 144, 146 of the capacitive patches is differentially coupled to a second tuning element 122 for adjusting a second terminating impedance of parasitic element 104.

Tuning elements 120, 122 are coupled to a controller 124 for adjusting the first and second terminating impedances. In some embodiments, controller 124 may be a processor-based computing device such as a microcontroller. In some embodiments, controller 124 may comprise hardware logic. In some embodiments, controller 124 may be omitted and tuning elements 120, 122 may provide for fixed first and second terminating impedances for parasitic element 104. In some embodiments, the antenna may be provided to a user as an independent antenna module without the controller 124, and the independent antenna module may be subsequently coupled to a user-provided controller. In some other embodiments, a device may be provided to a user including both the antenna and the controller 124.

In an example embodiment, tuning elements 120, 122 may comprise reverse-biased varactor diodes, either alone or in combination with other electronic components. In embodiments using reverse-biased varactor diodes, a supplied DC bias voltage across each varactor diode controls the varactor diode's junction capacitance, with each varactor diode thereby acting as a low cost means of tuning a reactive loading provided by each varactor diode's respective capacitive patches on the parasitic element 104. Reactive loading, or reactance, is the imaginary part of electrical impedance. Tuning the reactive loading of parasitic element 104 adjusts the terminating impedance of parasitic element 104.

Other components capable of adjusting the terminating impedance of parasitic element 104 may be used as tuning elements instead of varactor diodes in some embodiments. For example, in some embodiments, PIN diodes, micro-electro-mechanical systems (MEMS), and/or voltage controlled capacitors may be used instead of, or in addition to, varactor diodes.

The terminating impedances may be reactive, resistive, or a combination of reactive and resistive. In some embodiments, tuning the terminating impedances involves tuning the reactance. Tuning the junction capacitance of a varactor diode as described above is a specific example. In other embodiments, the resistive part of the terminating impedance of parasitic element 104 is varied in addition to the reactive part. Adjusting the real part of the termination is generally a source of power loss, and may tend to reduce the amplitude of the parasitic radiation from parasitic element 104. This change in amplitude can be of use in facilitating beam steering for applications where power losses are acceptable.

In the embodiment illustrated in FIG. 1, for both the main element 102 and the parasitic element 104, each differential coupling described above is accomplished through a passive circuit involving electrical connections having paths of differing lengths. In each passive circuit, the length of the electrical connection along each path is selected so that signals at a desired wavelength for communication will arrive at their respective capacitive patches with an opposite phase. In a specific example of such a differential coupling, passive circuit 147 interconnects first terminal 150 and capacitive patches 130, 132. It should be understood that the illustrated form of differential coupling is intended only as an example, and that other forms of differential coupling may be used. For example, active electronic circuits may be used to generate signals having opposite phases.

The shapes and configuration of driven element 102 and capacitive patches 130, 132, 134, 136 have been selected so that driven element 102 is in a capacitive coupling arrangement with these capacitive patches. Likewise, the shapes and configuration of parasitic element 104 and capacitive patches 140, 142, 144, 146 have been selected so that parasitic element 104 is in a capacitive coupling arrangement with these capacitive patches. It should be understood that other shapes and configurations are possible. For example, in some embodiments, at least one of driven element 102 and parasitic element 104 may have a square shape with a hollow interior. In some embodiments, capacitive patches 130, 132, 134, 136, 140, 142, 144, 146 may be square. In some embodiments, terminals 150, 152 may be coupled to driven element 102 using aperture coupling. In some embodiments, tuning elements 120, 122 may be coupled to parasitic element 104 using aperture coupling.

Parasitic element 104 is located in sufficient proximity to driven element 102 so that the parasitic element 104 and the driven element 102 are electromagnetically coupled in a parasitic coupling arrangement. It should be understood that the illustrated spatial relationship between parasitic element 104 and driven element 102 is intended as an example, but that other spatial relationships are possible to adjust the characteristics of the parasitic coupling. For example, the distance between driven element 102 and parasitic element 104 is a design parameter. As another example, although parasitic element 104 and driven element 102 are illustrated in FIG. 1 as being in the same plane, in some embodiments parasitic element 102 may be situated on a plane that is spatially offset from a plane on which driven element 102 is located, and the magnitude of this spatial offset is a design parameter. Also, in some embodiments the shapes of driven element 102 and parasitic element 104 may be varied as a design parameter. For example, although the illustrated shape of parasitic element 104 may in some embodiments improve the parasitic coupling with driven element 102, in other embodiments parasitic element 104 may have a square shape.

The antenna shown in FIG. 1 may be used for transmitting or receiving signals. The transmitting operation of the antenna will now be described, however it should be understood that the same beam steering principles are applicable to radiating and receiving beams from the antenna.

For illustrative purposes, a right-handed orthogonal coordinate frame is shown. X axis 106 is normal to the surface of driven element 102, while Y axis 108 and Z axis 110 lie parallel to the surface of driven element 102. It should be understood that this specific labeling of the coordinate axes is arbitrary. In some example applications where the antenna may be used to communicate with mobile phones, the antenna may be installed in an orientation where the labeled Z axis no is oriented towards the sky, and the plane formed by the labeled X axis 106 and Y axis 108 is tangent to the Earth's surface.

For transmission, the first terminal 150 serving as the first port supplies a first signal for transmission by a first beam 112. The second terminal 152 serving as the second port supplies a second signal for transmission by a second beam 114. The first beam 112 is shown being radiated from the antenna in a first direction at an azimuth angle $\phi_1$ from X axis 102 in the XY plane. A second beam 114 is shown being radiated from the antenna in a second direction at an azimuth angle $\phi_2$ from X axis 102 in the XY plane. Beams 112, 114 are illustrated as being radiated from a point between driven element 102 and parasitic element 104. This is because beams 112, 114 are intended to depict the resultant superposition (i.e., the combination) of radiation emanating directly from driven element 102 and radiation emanating parasitically from parasitic element 104. The first beam 112 has a first polarization, and the second beam 114 has a second polarization. In the illustrated embodiment, the first and second polarizations are substantially orthogonal and independently configurable.

In transmitting operation, the first signal applied to the first terminal 150 differentially drives capacitive patches 130, 132, and the second signal applied to the second terminal 152 differentially drives capacitive patches 134, 136. Through capacitive coupling with driven element 102, capacitive patches 130, 132 excite radiation from driven element 102 contributing to the first beam 112. Similarly, through capacitive coupling with driven element 102, capacitive patches 134, 136 excite radiation from the driven element 102 contributing to the second beam 114.

If parasitic element 104 were not present, lobes of the beams 112, 114 would generally be oriented perpendicular to the plane of driven element 102, i.e., along X axis 106. However, because driven element 102 and parasitic element 104 are in a parasitic coupling arrangement, parasitic element 104 acts as an excited element with some excitation offset in phase and amplitude from excitation of the driven element 102. Waves thereby radiated from parasitic element 104 contribute to the first beam 112 and the second beam 114 by superposition with waves radiated from the driven element 102.

The terminating impedances determined by tuning elements 120, 122 vary the effects of the mutual coupling between driven element 102 and parasitic element 104 by altering the excitation offset phase of parasitic element 104. The excitation offset amplitude is substantially determined by the distance between driven element 102 and parasitic element 104. However, in some alternate embodiments the excitation offset amplitude may also be varied, for example by adjusting the real part of the termination impedances determined by tuning elements 120, 122 as explained above. The variation in excitation offset phase of parasitic element 104 affects angles $\phi_1$, $\phi_2$ at which beams 112, 114 resulting from the superposition of radiation from driven element 102 and parasitic element 104 are emitted from the antenna. As tuning element 120 increases the first terminating impedance, parasitic element 104 acts increasingly as a reflector and has the effect of urging the direction of the first beam 112 away from parasitic element 104. As tuning element 120 decreases the first terminating impedance, parasitic element 104 acts increasingly as a director and has the effect of urging the direction of the first beam 112 towards parasitic element 104. Likewise, as tuning element 122 increases or decreases the second terminating impedance, the direction of the second beam 114 is urged away or towards parasitic element 104, respectively.

Accordingly, by electrically adjusting the first and/or second terminating impedances using tuning elements 120, 122, respectively, the direction of the first beam 112 and/or second beam 114 may be adjusted. In some embodiments, the direction of the first beam may be adjusted without substantially affecting the direction of the second beam, and vice-versa. That is, the direction of the first beam may be adjusted substantially independently of the direction of the second beam. Also, the direction of the first beam and the direction of the second beam may be adjusted sequentially or simultaneously. Of note, the same antenna elements 102, 104 may be used to emit and steer both polarizations emitted from the antenna.

In some embodiments, the controller 124 may electrically adjust the first and/or second terminating impedances by consulting a look up table of radiation patterns. For example, the controller 124 may consult a look up table mapping desired directions of the first beam 112 and/or second beam 114 to particular bias voltages to use with tuning elements 120 and/or 122. Values in the look up table may be experimentally determined and/or determined through simulation and analysis.

Figure 2A:
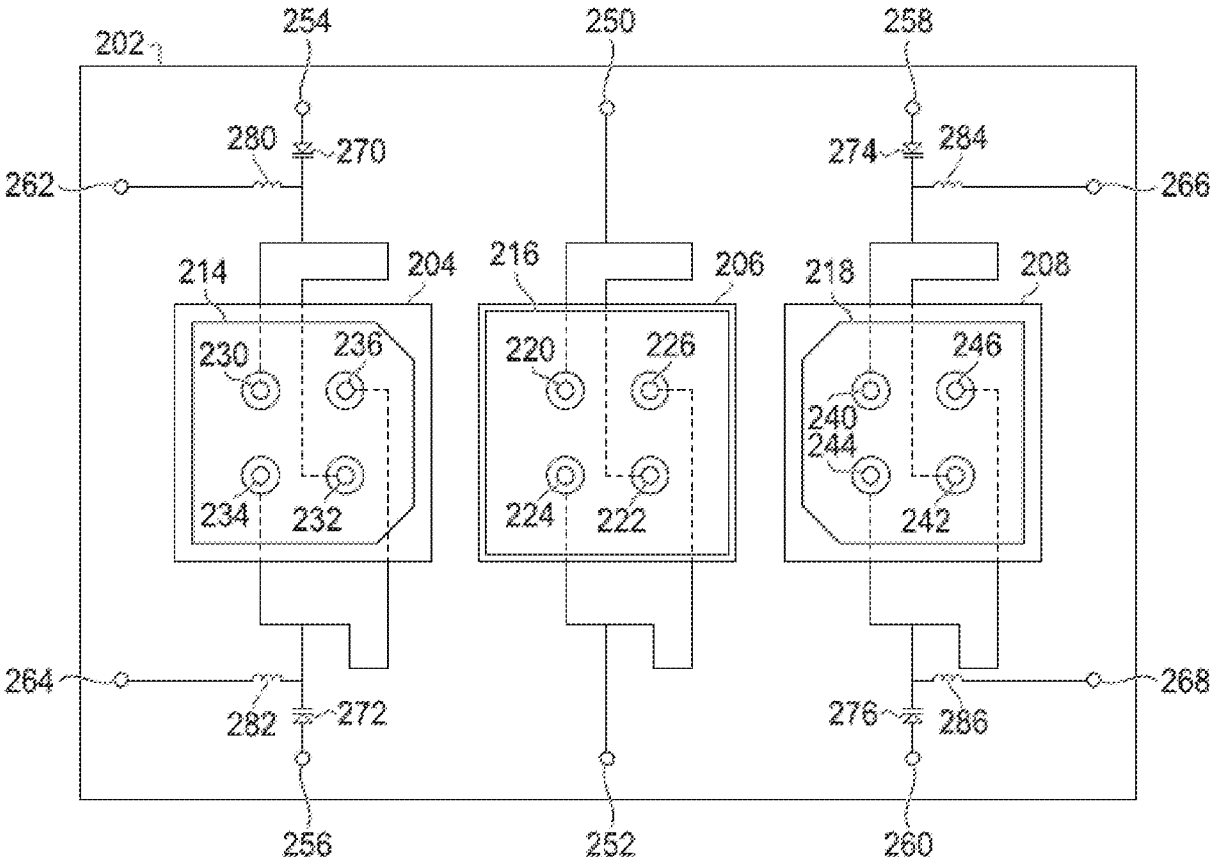
FIG. 2A is a plan view of another dual polarized ESPAR antenna in accordance with an embodiment of the invention.
Figure 2B:
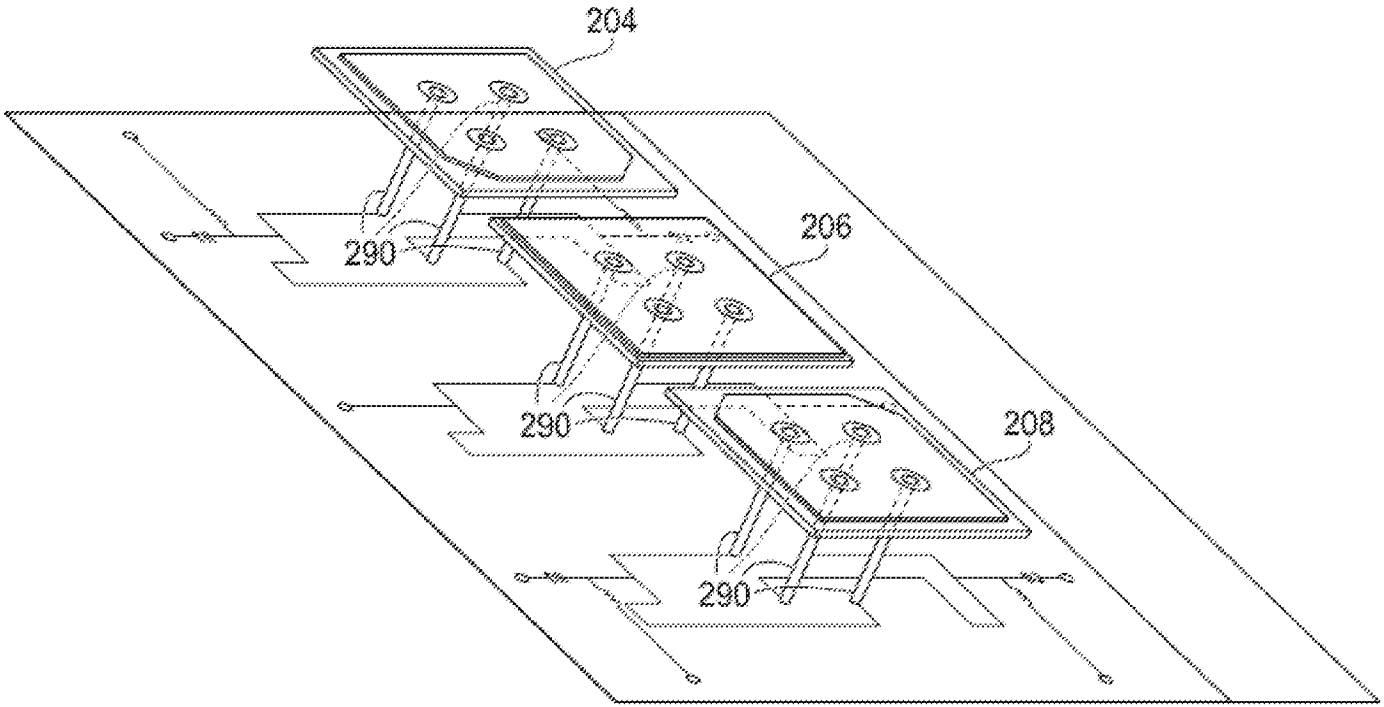
FIG. 2B is a perspective view of the dual polarized ESPAR antenna of FIG. 2A.

FIGS. 2A and 2B depict a dual polarized ESPAR antenna in accordance with another embodiment of the invention. FIG. 2A shows the antenna in plan view, and FIG. 2B shows the antenna in perspective view.

In the embodiment shown in FIGS. 2A and 2B, a main PCB 202 acts as a supporting substrate for a driven element PCB 206, a first parasitic element PCB 204, and a second parasitic element PCB 208. Driven element PCB 206 contains a patch of conductive material serving as driven element 216. Parasitic element PCBs 204, 208 contain patches of conductive material serving as first and second parasitic elements 214, 218, respectively. Conductive feed probes 290 are electrically coupled to capacitive patches 220, 222, 224, 226 on driven element PCB 206, capacitive patches 230, 232, 234, 236 on first parasitic element PCB 204, and capacitive patches 240, 242, 244, 246 on second parasitic element PCB 208. The conductive feed probes 290 support driven element PCB 206 and first and second parasitic element PCBs 204, 208 above main PCB 202.

In the embodiment shown, the driven element PCB 206 is not supported as far above main PCB 202 as the first and second parasitic element PCBs 204, 208. In some embodiments, the illustrated spatial relationship between the driven element 216 and the first and second parasitic elements 214, 218 has been found to improve parasitic coupling between the driven element and the parasitic elements. However, it should be understood that other spatial relationships between the driven element 216 and the parasitic elements 214, 218 are possible. For example, the differing support heights for the parasitic elements 214, 218 as opposed to the driven element 216 provide a design parameter, in addition to the spacing between the driven and parasitic elements, that will affect the parasitic coupling and may be varied in some embodiments. Also, in some embodiments other means of supporting the driven element 216 and the parasitic elements 214, 218 above the main PCB 202 may be used. For example, in some embodiments the driven element PCB 206 and the first and second parasitic element PCBs 204, 208 may be physically supported on a non-conductive support structure and connected to the main PCB 202 with wires. Alternatively, in some embodiments the driven element PCB 206 and the first and second parasitic element PCBs 204, 208 may be integrated into a multilayer PCB.

Similar to the embodiment shown in FIG. 1, driven element 216 has a square shape, and parasitic elements 214, 218 each have a shape based on a square, wherein two corners of a side of the squares facing driven element 216 have had triangular portions cut away. As explained above with respect to FIG. 1, in some embodiments, the illustrated shape for parasitic elements 214, 218 has been found to improve parasitic coupling between the driven element 216 and the parasitic elements 214, 218. However, it should be understood that other shapes are possible. For example, parasitic elements 214, 218 may have square shapes.

Capacitive patches 220, 222, 224, 226 are arranged relative to driven element 216 like the arrangement shown with respect to driven element 102 in FIG. 1. Capacitive patches 230, 232, 234, 236 and 240, 242, 244, 246 are arranged relative to first parasitic element 214 and second parasitic element 218 like the arrangement shown with respect to parasitic element 104 in FIG. 1.

A first pair of capacitive patches 220, 222 are differentially coupled to a first terminal 250 serving as a first port for supplying signals for transmission or outputting signals received. A second pair of capacitive patches 224, 226 are differentially coupled to a second terminal 252 serving as a second port for supplying signals for transmission or outputting signals received.

With respect to the first parasitic element 214, a first pair of capacitive patches 230, 232 are differentially coupled to a first varactor 270 serving as a first tuning element. First varactor 270 is also coupled to ground using a ground lug 254. A DC bias voltage is supplied to the first varactor 270 from first bias terminal 262 and intervening inductor 280. A second pair of capacitive patches 230, 232 are differentially coupled to a second varactor 274 serving as a second tuning element. Second varactors 274 is also coupled to ground using a ground lug 256. A DC bias voltage is supplied to the second varactor 274 from second bias terminal 264 and intervening inductor 282.

The second parasitic element 218 is configured in an analogous manner to the first parasitic element 214. Elements 274 and 276 are varactors, elements 266 and 268 are bias terminals for supplying biasing voltages to varactors 274 and 276, respectively, elements 284 and 286 are capacitors, and elements 258 and 260 are ground lugs.

In the embodiment shown, varactors 270, 272, 274, 276 are reverse-biased varactor diodes. In this configuration, the respective supplied DC bias voltage across each varactor controls the varactor's junction capacitance, thereby tuning a reactive loading provided by the varactor's respective capacitive patches on their respective parasitic element. Tuning the reactive loading of the parasitic elements 214, 218 adjusts their respective terminating impedances.

In some other embodiments, different components for adjusting the terminating impedance of parasitic elements 214, 218 may be used instead of, or in addition to, varactor diodes. For example, some embodiments may make use of the possible tuning elements discussed above with respect to the embodiment shown in FIG. 1.

In the illustrated embodiment of FIGS. 2A and 2B, inductors 280, 282, 284, 286 act as radio frequency (RF) chokes to isolate the DC bias voltages supplied to varactors 270, 272, 274, 276. In the embodiment shown, each of inductors 280, 282, 284, 286 has a value of 120 nH. However, it should be understood that other values of these inductors may be selected as an implementation parameter. For example, if different components for adjusting the terminating impedance of parasitic elements 214, 218 are used instead of, or in addition to, varactor diodes, different values of the inductors 280, 282, 284, 286 may be selected to allow the DC bias voltages to change the bias states of the particular components being used.

The antenna illustrated in FIGS. 2A and 2B may be used for transmitting or receiving signals. The transmitting operation of the antenna will now be described, however it should be understood that the same beam steering principles are applicable to radiating and receiving beams from the antenna.

For transmission, a first signal is applied to first terminal 250, differentially driving capacitive patches 220, 222, and a second signal is applied to second terminal 252, differentially driving capacitive patches 224, 226. Through capacitive coupling, capacitive patches 220, 222 excite radiation of a first beam (not shown) from the antenna, the first beam having a first polarization. Similarly, through capacitive coupling, capacitive patches 224, 226 excite radiation of a second beam (not shown) from the antenna, the second beam having a second polarization. In the illustrated embodiment, the first and second polarizations are substantially orthogonal.

The directions of the first and second beams are affected by mutual parasitic coupling of the driven element 216 and the parasitic elements 214, 218. By varying biasing voltages applied to bias terminals 262, 264, 266, and 268, terminating impedances of parasitic elements 214, 218 may be adjusted, thereby adjusting the directions of the first and second beams. In the illustrated embodiment, the direction of the first beam may be adjusted substantially independently of the direction of the second beam by varying biasing voltages applied to bias terminals 262, 266. The direction of the second beam may be adjusted substantially independently of the direction of the first beam by varying biasing voltages applied to bias terminals 264, 268. The direction of the first beam and the direction of the second beam may be adjusted sequentially or simultaneously.

Figure 3A:
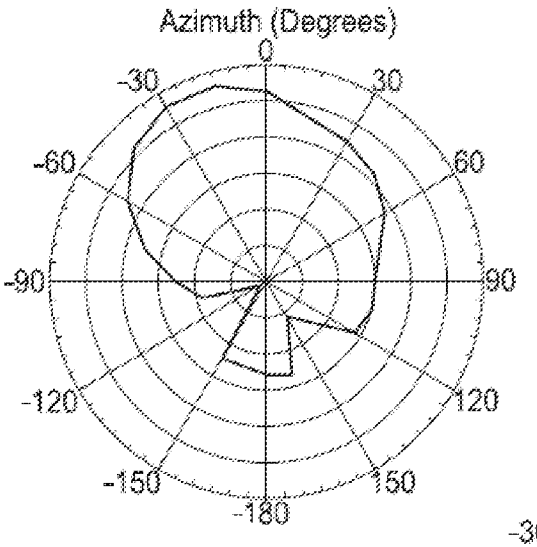
FIGS. 3A to 3C depict measured results of radiation patterns from a dual polarized ESPAR antenna in accordance with an embodiment as shown in FIGS. 2A and 2B.
Figure 3B:
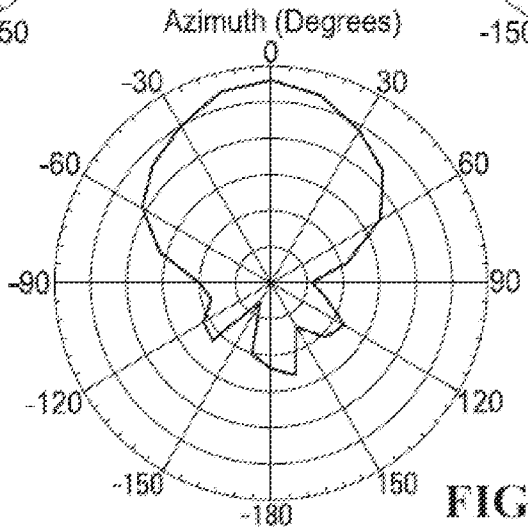
Figure 3C:
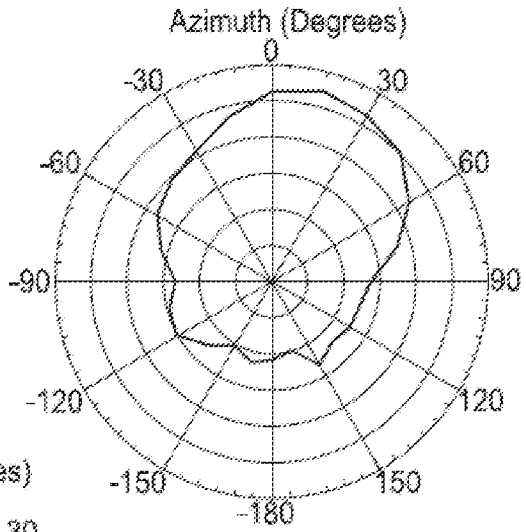

FIGS. 3A to 3C depict measured radiation patterns of the first beam from an example implementation of the embodiment as shown in FIGS. 2A and 2B. The depicted radiation patterns show the effects of different biasing voltages being applied to the bias terminals 262, 264, 266, 268. Each graph shows radiation of a 2.5 GHz transmission measured in a cross-section taken through the centroids of driven element 216 and parasitic elements 214, 218, with azimuth angle 0° representing radiation normal to driven element 216, positive azimuth angles representing radiation angled toward second parasitic element 218, and negative azimuth angles representing radiation angled toward first parasitic element 214.

FIG. 3A shows the radiation pattern when a 0 V bias voltage is applied to bias terminals 262, 264 and a 6.29 V bias voltage is applied to bias terminals 266, 268. With these bias voltages, the main lobe of the first beam has an azimuth angle of approximately −15°.

FIG. 3B shows the radiation pattern when a 6.29 V bias voltage is applied to all bias terminals 262, 264, 266, 268. With these bias voltages, the main lobe of the first beam has an azimuth angle of approximately 0°.

FIG. 3C shows the radiation pattern when a 6.29 V bias voltage is applied to bias terminals 262, 264 and a 0 V bias voltage is applied to bias terminals 266, 268. With these bias voltages, the main lobe of the first beam has an azimuth angle of approximately 15°.

With respect to the embodiment whose radiation patterns are shown in FIGS. 3A to 3C, measured cross-polarization between the first and second beams, for each of the combinations of bias voltages shown in FIGS. 3A to 3C, is lower than −10 dB. Measured return loss is lower than −12 dB. Electromagnetic coupling between terminals 250 and 252 is lower than approximately −25 dB.

Figure 4A:
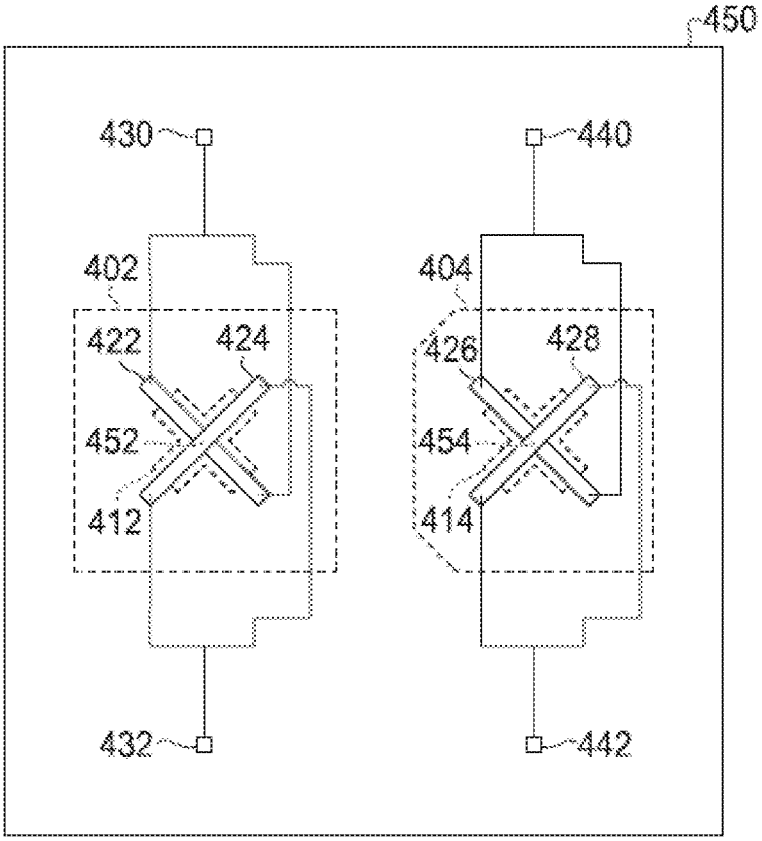
FIG. 4A is a diagrammatic underside view of another dual polarized ESPAR antenna in accordance with an embodiment of the invention.
Figure 4B:
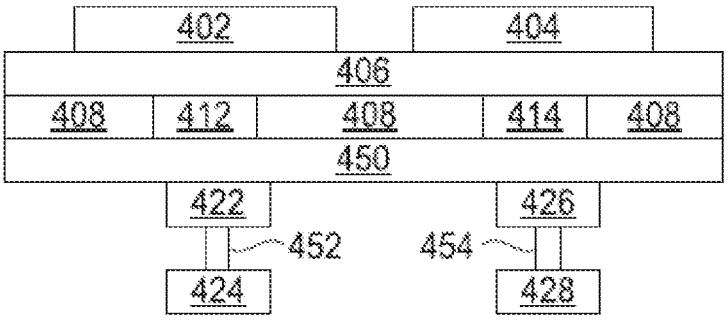
FIG. 4B is a diagrammatic side view of the dual polarized ESPAR antenna of FIG. 4A.

FIGS. 4A and 4B are diagrammatic views of another embodiment of a dual polarized ESPAR antenna using aperture coupling for driving each antenna element. FIG. 4A shows an underside view of the antenna, and FIG. 4B shows a side view of the antenna. In the example illustrated, driven element 402 and parasitic element 404 are patch antennas. Driven element 402 and parasitic element 404 are made of a conductive material and are supported by an electrically insulating patch substrate 406. Sandwiched between insulating substrate 406 and a microstrip substrate 450 is a ground plane substrate 408 with cross-shaped coupling apertures 412, 414 centered under driven element 402 and parasitic element 404, respectively. The crosses forming the cross-shaped coupling apertures 412, 414 are oriented at a 45° angle so as to be aligned with diagonals of driven element 402 and parasitic element 404, respectively.

Beneath driven element 402, a first driven microstrip 422 is fixed to the bottom of microstrip substrate 450. An electrically insulating material 452 is disposed below the first driven microstrip 422. Disposed below insulating material 452 is a second driven microstrip 424. The first driven microstrip 422 is differentially coupled to a first terminal 430 serving as a first port. The second driven microstrip 424 is differentially coupled to a second terminal 432 serving as a second port.

Beneath parasitic element 404, a first tuning microstrip 426 is also fixed to the bottom of microstrip substrate 450. An electrically insulating material 454 is disposed below the first tuning microstrip 426. Disposed below insulating material 454 is a second tuning microstrip 428. The first tuning microstrip 426 is differentially coupled to a first tuning element 440 for adjusting a first terminating impedance of parasitic element 404. The second tuning microstrip 428 is differentially coupled to a second tuning element 442 for adjusting a second terminating impedance of parasitic element 402. In some embodiments, tuning elements 440, 442 may comprise varactor diodes. In other embodiments, tuning elements 440, 442 may be other electronic components, for example component types discussed earlier with respect to the embodiments shown in FIG. 1 and/or FIGS. 2A and 2B.

In the illustrated embodiment, driven microstrips 422, 424, tuning microstrips 426, 428, and coupling apertures 412, 414 are symmetrically disposed about the centers of their respective driven element 402 or parasitic element 404. In other embodiments, driven microstrips 422, 424, tuning microstrips 426, 428, and coupling apertures 412, 414 may have other configurations. For example, in some embodiments driven microstrips 422, 424 and/or tuning microstrips 426, 428 may not cross over each other. In embodiments where driven microstrips 422, 424 and/or tuning microstrips 426, 428 do not cross, there may be less isolation between the dual polarizations of the antenna.

Parasitic element 404 is located in sufficient proximity to driven element 402 so that the parasitic element 404 and the driven element 402 are electromagnetically coupled in a parasitic coupling arrangement. In some embodiments, the spatial relationship between parasitic element 404 and driven element 402 may be varied as a design parameter, for example as described above with respect to the embodiments shown in FIG. 1 and/or FIGS. 2A and 2B.

The antenna illustrated in FIGS. 4A and 4B may be used for transmitting or receiving signals. The transmitting operation of the antenna will now be described, however it should be understood that the same beam steering principles are applicable to radiating and receiving beams from the antenna.

For transmission, the first terminal 430 serving as the first port supplies a first signal for transmission. The first signal differentially drives the first driven microstrip 422. The second terminal 432 serving as the second port supplies a second signal for transmission. The second signal differentially drives the second driven microstrip 424.

Aperture coupling between the first driven microstrip 422 and driven element 402 excites radiation of a first beam from the antenna, the first beam having a first polarization. Aperture coupling between the second driven microstrip 424 and driven element 402 excites radiation of a second beam from the antenna, the second beam having a second polarization. In the illustrated embodiment, the first and second polarizations are substantially orthogonal.

Due to aperture coupling between parasitic element 404 and the first tuning microstrip 426, adjustments to the first tuning element 440 cause the first terminating impedance of parasitic element 404 to vary. Also, due to aperture coupling between parasitic element 404 and the second tuning microstrip 428, adjustments to second tuning element 442 cause the second terminating impedance of parasitic element 404 to vary. Because driven element 402 and parasitic element 404 are in a parasitic coupling arrangement, the terminating impedances determined by tuning elements 440, 442 vary the effects of the mutual coupling between driven element 402 and parasitic element 404. Like the embodiment of FIG. 1, as the first terminating impedance varies, the direction of the first beam changes, and as the second terminating impedance varies, the direction of the second beam changes, thereby providing a means of steering the beams.

It should be understood that the particular structure and operation of the antenna shown in FIGS. 4A and 4B depicts an example embodiment, and that other variations in structure and operation are possible. For example, the shapes and/or sizes of coupling apertures 412, 414 may vary. In some embodiments, one of the driven element 402 or parasitic element 404 may use aperture coupling and the other may use capacitive coupling.

Figure 5:
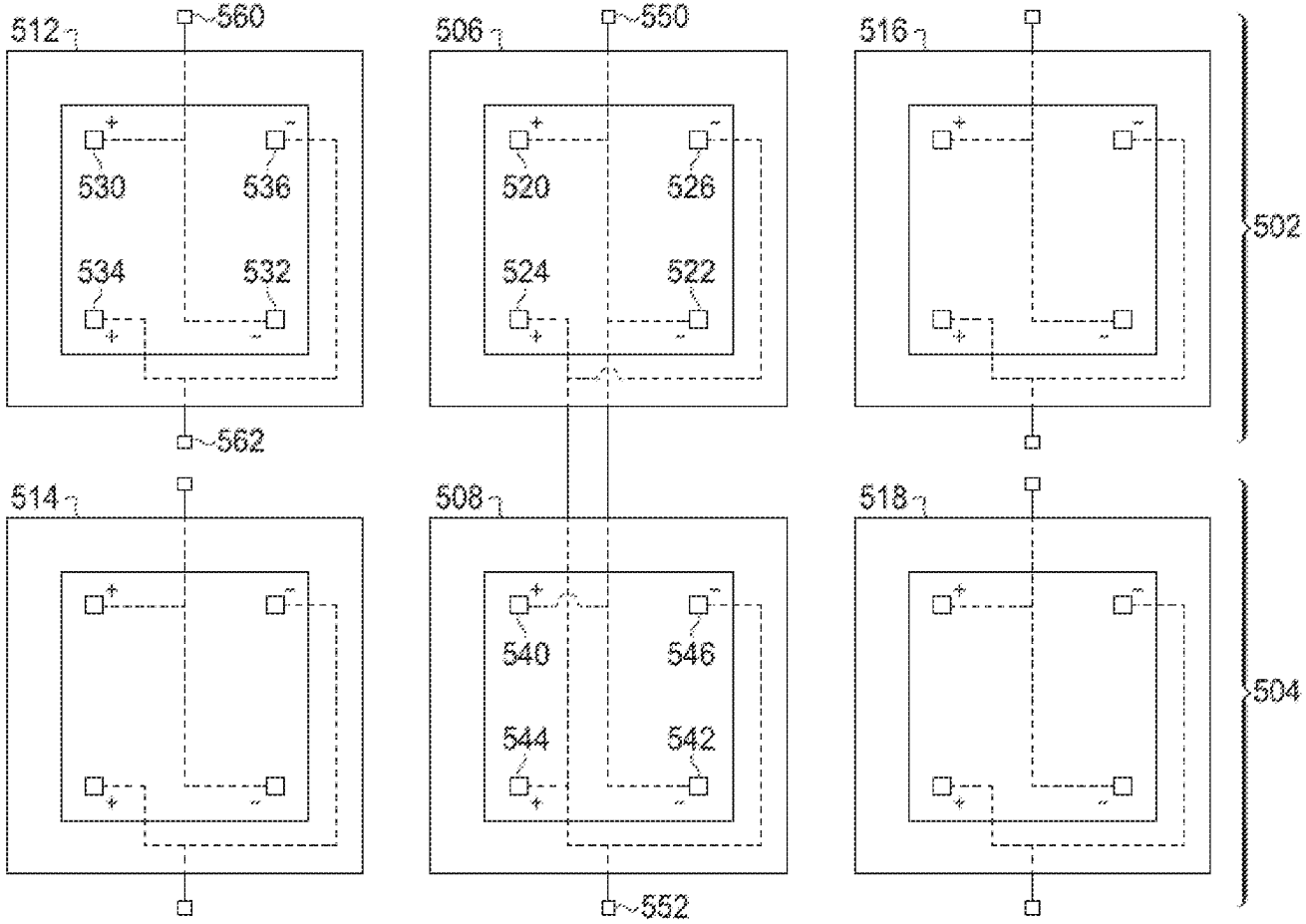
FIG. 5 is a diagrammatic plan view of another dual polarized ESPAR antenna in accordance with an embodiment of the invention.

FIG. 5 is a diagrammatic plan view of another embodiment of a dual polarized ESPAR antenna. In the illustrated embodiment, two assemblies 502, 504 each similar to the antenna configuration of FIGS. 2A and 2B have been arranged in an array. In the array, driven element 506 of first assembly 502 is aligned with driven element 508 of second assembly 504. The first parasitic elements 512, 514 and second parasitic elements 516, 518 of first assembly 502 and second assembly 504, respectively, are also aligned.

A first terminal 550 serving as a first port is coupled to a pair 520, 522 of capacitive patches in the first assembly 502 in a differential configuration, and also coupled to another pair 540, 542 of capacitive patches in the second assembly 504 in a differential configuration. For illustrative purposes, the specific details of the differential circuit are not shown, but the opposing polarities driving the capacitive patches are labelled as "+" and "−". A second terminal 552 serving as a second port is coupled to pairs 524, 526 and 544, 546 of capacitive patches in a similar manner as the first terminal 550.

A first tuning element 560 is differentially coupled to a pair 530, 532 of capacitive patches in the first parasitic element 512, and a second tuning element 562 is differentially coupled to another pair 534, 536 of capacitive patches in the first parasitic element 512. The other parasitic elements are configured in an analogous manner, although for diagrammatic simplicity the tuning elements and capacitive patches of the other parasitic elements are not numbered.

In the embodiment shown, the capacitive patches are all square in shape. The driven and parasitic elements all comprise patch antennas that are generally square in shape with an open interior. It should be understood that the illustrated embodiment is an example and that other configurations are possible. For example, in some embodiments the capacitive patches may be circular in shape and the patch antennas may have a generally closed interior like those in the embodiment shown in FIG. 1.

In transmitting operation, adjusting the tuning elements associated with each parasitic element permits steering of first and second beams emitted by the array, the first and second beams having different polarizations. Beam steering may similarly also be performed during receiving operation. In comparison to the embodiment illustrated in FIGS. 2A and 2B, the array formed by combining first assembly 502 and second assembly 504 may have a more focused beam along an axis normal to the array, while remaining steerable in azimuth like the embodiment of FIGS. 2A and 2B.

Figure 6:
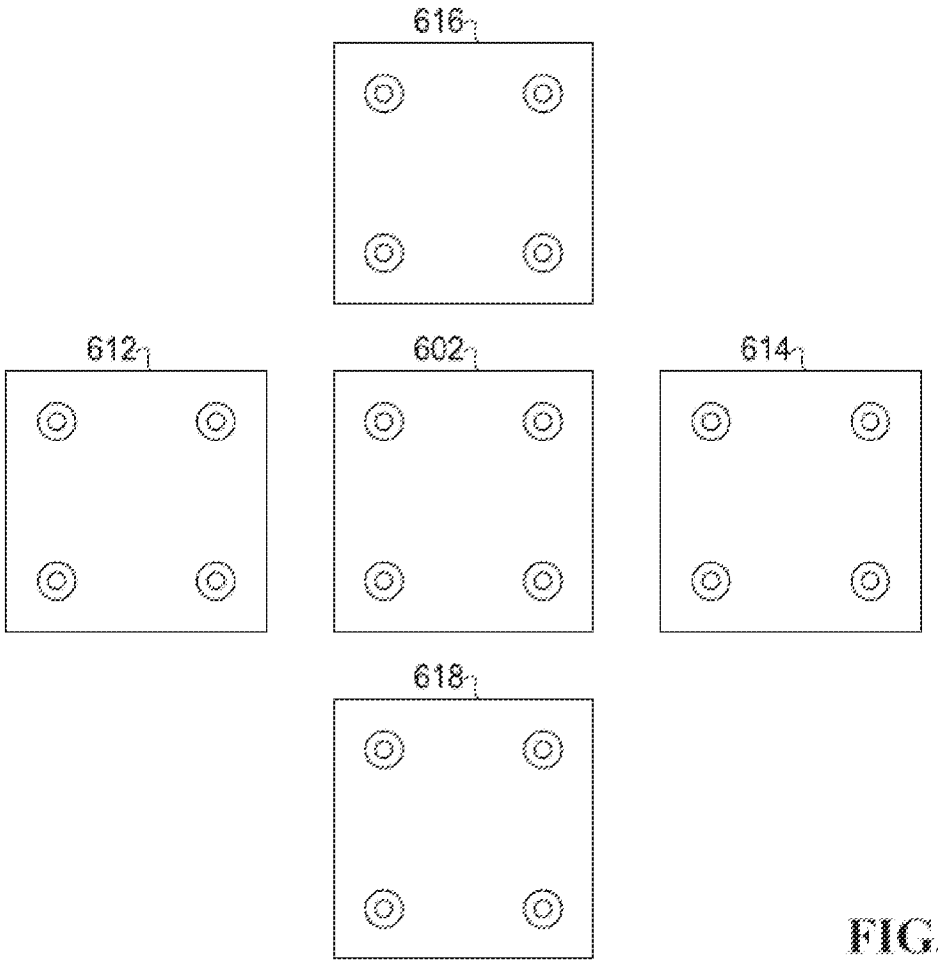
FIG. 6 is a diagrammatic plan view of the antenna elements of another dual polarized ESPAR antenna in accordance with an embodiment of the invention.

FIG. 6 is a diagrammatic plan view of another embodiment of a dual polarized ESPAR antenna. In the embodiment shown, driven element 602 is a square-shaped patch antenna element like the driven element 102 in the embodiment of FIG. 1. Each side of driven element 602 is flanked by one of parasitic elements 612, 614, 616, 616. Terminating impedances of each of the parasitic elements 612, 614, 616, 616 may be adjusted with tuning elements (not shown) like the tuning elements 120, 122 in the embodiment of FIG. 1. The illustrated configuration of parasitic elements may thereby permit beams of the antenna to be steered in two dimensions. That is, using the tuning elements, beams of the antenna may be steered towards or away from each of the parasitic elements 612, 614, 616, 616.

Figure 7:
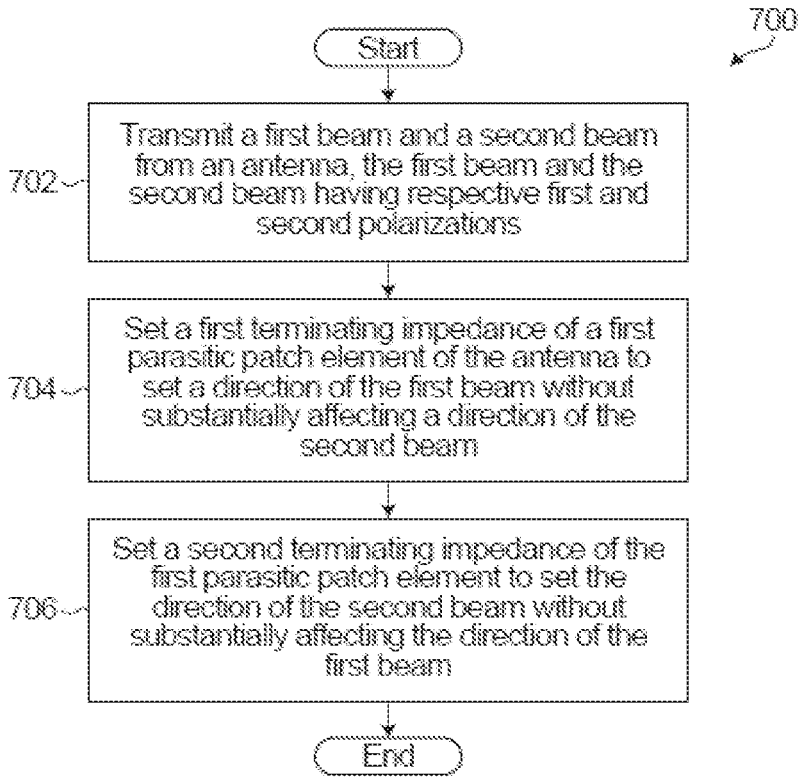
FIG. 7 is a flow diagram of a method for steering first and second beams of a dual polarized ESPAR antenna in accordance with an embodiment of the invention.

FIG. 7 is a flow diagram of an embodiment of a method 700 for steering first and second beams from an antenna. The method is for use in an antenna having a first parasitic patch element separated from a driven patch element, the first parasitic patch element parasitically coupled to the driven patch element.

Upon starting, the method proceeds to block 702. In block 702, a first and a second beam are transmitted from an antenna, the first beam and the second beam having respective first and second polarizations.

The method then proceeds to block 704, which involves setting a first terminating impedance of the first parasitic patch element of the antenna, in order to set a direction of the first beam without substantially affecting a direction of the second beam.

The method then proceeds to block 706, which involves setting a second terminating impedance of the first parasitic patch element, in order to set the direction of the second beam without substantially affecting the direction of the first beam.

Although method 700 is depicted as a series of sequential steps, it should be understood that in some embodiments the steps may be performed in a different order. For example, the method step of block 706 may be performed before the method step of block 704, or the method steps of blocks 704 and 706 may be performed simultaneously.

In a variation of the method illustrated in FIG. 7, the antenna may have a second parasitic patch element separated from the driven patch element, the second parasitic patch element also parasitically coupled to the driven patch element. In this variation, a first terminating impedance of the second parasitic patch element of the antenna may also be set while setting the first terminating impedance of the first parasitic patch element, in order to set the direction of the first beam without substantially affecting the direction of the second beam. Further, a second terminating impedance of the second parasitic patch element of the antenna may also be set while setting the second terminating impedance of the first parasitic patch element, in order to set the direction of the second beam without substantially affecting the direction of the first beam.

In some embodiments, a non-transitory computer readable medium comprising instructions for execution by a processor may be provided to control execution of the method 700 illustrated in FIG. 7, to implement another method described above, and/or to facilitate the implementation and/or operation of an apparatus described above. In some embodiments, the processor may be a component of a general-purpose computer hardware platform. In other embodiments, the processor may be a component of a special-purpose hardware platform. For example, the processor may be an embedded processor, and the instructions may be provided as firmware. Some embodiments may be implemented by using hardware only. In some embodiments, the instructions for execution by a processor may be embodied in the form of a software product. The software product may be stored in a non-volatile or non-transitory storage medium, which can be, for example, a compact disc read-only memory (CD-ROM), USB flash disk, or a removable hard disk.

The previous description of some embodiments is provided to enable any person skilled in the art to make or use an apparatus, method, or processor readable medium according to the present disclosure. Various modifications to these embodiments will be readily apparent to those skilled in the art, and the generic principles of the methods and devices described herein may be applied to other embodiments. Thus, the present disclosure is not intended to be limited to the embodiments shown herein but is to be accorded the widest scope consistent with the principles and novel features disclosed herein.

What is claimed is:

1. A method comprising:

setting a first terminating impedance of a first parasitic patch element of an antenna to set a first direction of a first beam without substantially affecting a second direction of a second beam, the first parasitic patch element separated from and parasitically coupled to a driven patch element of the antenna;

setting a second terminating impedance of the first parasitic patch element to set the second direction of the second beam without substantially affecting the first direction of the first beam, the first beam and the second beam provided by the driven patch element electromagnetically interacting with the first parasitic patch element; and transmitting the first beam and the second beam from the antenna, the first beam having a first polarization and the second beam having a second polarization.

2. The method of claim 1, further comprising:

setting a third terminating impedance of a second parasitic patch element of the antenna, while setting the first terminating impedance of the first parasitic patch element, to further set the first direction of the first beam without substantially affecting the second direction of the second beam, the second parasitic patch element separated from and parasitically coupled to the driven patch element; and setting a fourth terminating impedance of the second parasitic patch element, while setting the second terminating impedance of the first parasitic patch element, to further set the second direction of the second beam without substantially affecting the first direction of the first beam.

3. The method of claim 2, further comprising:

setting a fifth terminating impedance of a third parasitic patch element of the antenna, while setting the first terminating impedance of the first parasitic patch element, to further set the first direction of the first beam without substantially affecting the second direction of the second beam, the third parasitic patch element separated from and parasitically coupled to the driven patch element;

setting a sixth terminating impedance of the third parasitic patch element, while setting the second terminating impedance of the first parasitic patch element, to further set the second direction of the second beam without substantially affecting the first direction of the first beam;

setting a seventh terminating impedance of a fourth parasitic patch element of the antenna, while setting the first terminating impedance of the first parasitic patch element, to further set the first direction of the first beam without substantially affecting the second direction of the second beam, the fourth parasitic patch element separated from and parasitically coupled to the driven patch element; and setting an eighth terminating impedance of the fourth parasitic patch element, while setting the second terminating impedance of the first parasitic patch element, to further set the second direction of the second beam without substantially affecting the first direction of the first beam.

4. The method of claim 1, further comprising using a look up table of radiation patterns to set values for the first and second terminating impedances.

5. The method of claim 1, wherein:

setting the first terminating impedance comprises adjusting a first bias voltage of a first varactor; and setting the second terminating impedance comprises adjusting a second bias voltage of a second varactor.

6. The method of claim 1, wherein the first polarization and the second polarization are orthogonal.

7. The method of claim 1, further comprising controlling the first and second terminating impedances with first and second tuning elements, respectively, comprising any one of varactors, PIN diodes or micro-electromechanical systems (MEMS).

8. The method of claim 7, further comprising:

differentially coupling the first parasitic patch element to the first tuning element using first capacitive patches or a first aperture coupling, and differentially coupling the first parasitic patch element to the second tuning element using second capacitive patches or a second aperture coupling.

9. The method of claim 1, further comprising:

receiving a first signal at a first port for transmission by the first beam, the driven patch element being differentially coupled to the first port; and receiving a second signal at a second port for transmission by the second beam, the driven patch element being differentially coupled to the second port.

10. The method of claim 9, further comprising:

differentially coupling the driven patch element to the first port using a first passive circuit having first arms of differing lengths or using a first active electronic circuit generating opposite phase signals, and differentially coupling the driven patch element to the second port using a second passive circuit having second arms of differing lengths or using a second active electronic circuit generating opposite phase signals.

11. The method of claim 9, further comprising:

differentially coupling the driven patch element to the first port using a first pair of capacitive patches or a first aperture; and differentially coupling the driven patch element to the second port using a second pair of capacitive patches or a second aperture.

12. A method comprising:

setting a first terminating impedance of a first parasitic patch element of an antenna to set a first direction of a first beam without substantially affecting a second direction of a second beam, the first parasitic patch element separated from and parasitically coupled to a driven patch element of the antenna;

setting a second terminating impedance of the first parasitic patch element to set the second direction of the second beam without substantially affecting the first direction of the first beam, the first beam and the second beam provided by the driven patch element electromagnetically interacting with the first parasitic patch element; and receiving the first beam and the second beam by the antenna, the first beam having a first polarization and the second beam having a second polarization.

13. The method of claim 12, further comprising:

setting a third terminating impedance of a second parasitic patch element of the antenna, while setting the first terminating impedance of the first parasitic patch element, to further set the first direction of the first beam without substantially affecting the second direction of the second beam, the second parasitic patch element separated from and parasitically coupled to the driven patch element; and setting a fourth terminating impedance of the second parasitic patch element, while setting the second terminating impedance of the first parasitic patch element, to further set the second direction of the second beam without substantially affecting the first direction of the first beam.

14. The method of claim 13, further comprising:

setting a fifth terminating impedance of a third parasitic patch element of the antenna, while setting the first terminating impedance of the first parasitic patch element, to further set the first direction of the first beam without substantially affecting the second direction of the second beam, the third parasitic patch element separated from and parasitically coupled to the driven patch element;

setting a sixth terminating impedance of the third parasitic patch element, while setting the second terminating impedance of the first parasitic patch element, to further set the second direction of the second beam without substantially affecting the first direction of the first beam;

setting a seventh terminating impedance of a fourth parasitic patch element of the antenna, while setting the first terminating impedance of the first parasitic patch element, to further set the first direction of the first beam without substantially affecting the second direction of the second beam, the fourth parasitic patch element separated from and parasitically coupled to the driven patch element; and setting an eighth terminating impedance of the fourth parasitic patch element, while setting the second terminating impedance of the first parasitic patch element, to further set the second direction of the second beam without substantially affecting the first direction of the first beam.

15. The method of claim 12, further comprising using a look up table of radiation patterns to set values for the first and second terminating impedances.

16. The method of claim 12, wherein:

setting the first terminating impedance comprises adjusting a first bias voltage of a first varactor; and setting the second terminating impedance comprises adjusting a second bias voltage of a second varactor.

17. The method of claim 12, wherein the first polarization and the second polarization are orthogonal.

18. The method of claim 12, further comprising controlling the first and second terminating impedances with first and second tuning elements, respectively, comprising any one of varactors, PIN diodes or micro-electromechanical systems (MEMS).

19. The method of claim 18, further comprising:

differentially coupling the first parasitic patch element to the first tuning element using first capacitive patches or a first aperture coupling, and differentially coupling the first parasitic patch element to the second tuning element using second capacitive patches or a second aperture coupling.

20. The method of claim 12, further comprising:

outputting, at a first port, a first signal received by the first beam, the driven patch element being differentially coupled to the first port; and outputting, at a second port, a second signal received by the second beam, the driven patch element being differentially coupled to the second port.

21. The method of claim 20, further comprising:

differentially coupling the driven patch element to the first port using a first passive circuit having first arms of differing lengths or using a first active electronic circuit generating opposite phase signals, and differentially coupling the driven patch element to the second port using a second passive circuit having second arms of differing lengths or using a second active electronic circuit generating opposite phase signals.

22. The method of claim 20, further comprising:

differentially coupling the driven patch element to the first port using a first pair of capacitive patches or a first aperture; and differentially coupling the driven patch element to the second port using a second pair of capacitive patches or a second aperture.

* * * * *